US005372101A

United States Patent [19]

Hoshiba et al.

[11] Patent Number: 5,372,101

[45] Date of Patent: Dec. 13, 1994

[54] FUEL FEEDING DEVICE FOR INTERNAL COMBUSTION ENGINE

[75] Inventors: Akihiko Hoshiba; Masaki Okazaki, both of Hamamatsu, Japan

[73] Assignee: Sanshin Kogyo Kabushiki Kaisha, Hamamatsu, Japan

[21] Appl. No.: 53,154

[22] Filed: Apr. 27, 1993

[30] Foreign Application Priority Data

May 12, 1992 [JP] Japan ..... 4-146693

[51] Int. Cl.[5] ..... F02M 1/10; F02M 1/12

[52] U.S. Cl. ..... 123/179.15

[58] Field of Search ..... 123/179.15, 179.13, 123/179.18, 179.12, 179.14

[56] References Cited

U.S. PATENT DOCUMENTS

| | | | |
|---|---|---|---|
| 2,905,165 | 9/1959 | Hall | 123/179.14 |
| 3,706,444 | 12/1972 | Masaki et al. | 123/179.14 |
| 4,554,896 | 11/1985 | Sougawa | 123/179.15 |
| 5,121,719 | 6/1992 | Okazaki et al. | 123/179.18 |
| 5,150,673 | 9/1992 | Hoshiba et al. | 123/179.15 |

*Primary Examiner*—Andrew M. Dolinar

*Attorney, Agent, or Firm*—Knobbe, Martens, Olson & Bear

[57] ABSTRACT

Two embodiments of cold starting and cold running enrichment devices for internal combustion engines, each of which provide an amount of fuel through a first circuit under the control of a first control valve during cold cranking for cold starting enrichment and a second fuel circuit having a second control valve for supplying fuel to the engine for cold running enrichment. In this way, adequate amounts of fuel are supplied under all circumstances.

10 Claims, 9 Drawing Sheets

FUEL FEEDING DEVICE FOR INTERNAL COMBUSTION ENGINE

BACKGROUND OF THE INVENTION

This invention relates to a fuel feeding device for an internal combustion engine and more particularly to an improved fuel feeding system that assist in starting and cold warm-up.

It is well known that the fuel/air requirements of an engine vary in response to engine temperature. It has been the practice to provide some form of fuel enrichment during cold warm-up so as to insure even running of the engine and to avoid stalling. Of course, these systems are will, when the temperature is low, provide additional fuel when the engine is being cranked for starting. However, even the provision of such a cold running enrichment during starting operation will not provide adequate fuel flow to the engine so as to insure quick starting, particularly at low temperatures.

On the other hand, if the system is designed so as to provide adequate fuel for cold starting, then too much fuel will be provided to the engine during cold running and cold warm-up. That is, the temperature responsive valves proposed for cold running enrichment, if they provide adequate fuel for cold starting, will provide too much fuel once the engine has started and before it is fully warmed up.

Although devices have been provided that supply additional fuel during cranking in addition to cold running, these devices do not provide the optimum amount of fuel for both conditions. That is, these devices either supply fuel through the same fuel circuit and thus cannot offer adequate control, or supply only fuel to the engine for both cold enrichment and cold starting. As a result, it is not possible to tailor the fuel/air mixture for the engine to suit all running conditions including starting.

It is, therefore, the principal object to this invention to provide an improved arrangement for cold starting and cold running enrichment of an engine.

It is a further object to this invention to provide a cold starting and cold running enrichment system for an engine wherein the cold starting and cold running enrichments are supplied by different circuits having different controls.

It is a still further object to this invention to provide a cold starting and cold running enrichment system for an engine wherein only fuel is supplied for the cold starting operation whereas both fuel and air are mixed together and supplied for cold running enrichment.

SUMMARY OF THE INVENTION

This invention is adapted to be embodied in a cold starting and running enrichment device for supplying fuel to an engine for cold starting and cold running enrichment which comprises a first fuel circuit having a first control valve for supplying a first amount of fuel to the engine for cold starting purposes and a second fuel circuit having a second control valve for supplying a second amount of fuel to said engine for cold running enrichment.

DETAILED DESCRIPTION OF THE PREFERRED EMBODIMENTS OF THE INVENTION

Figure 1:
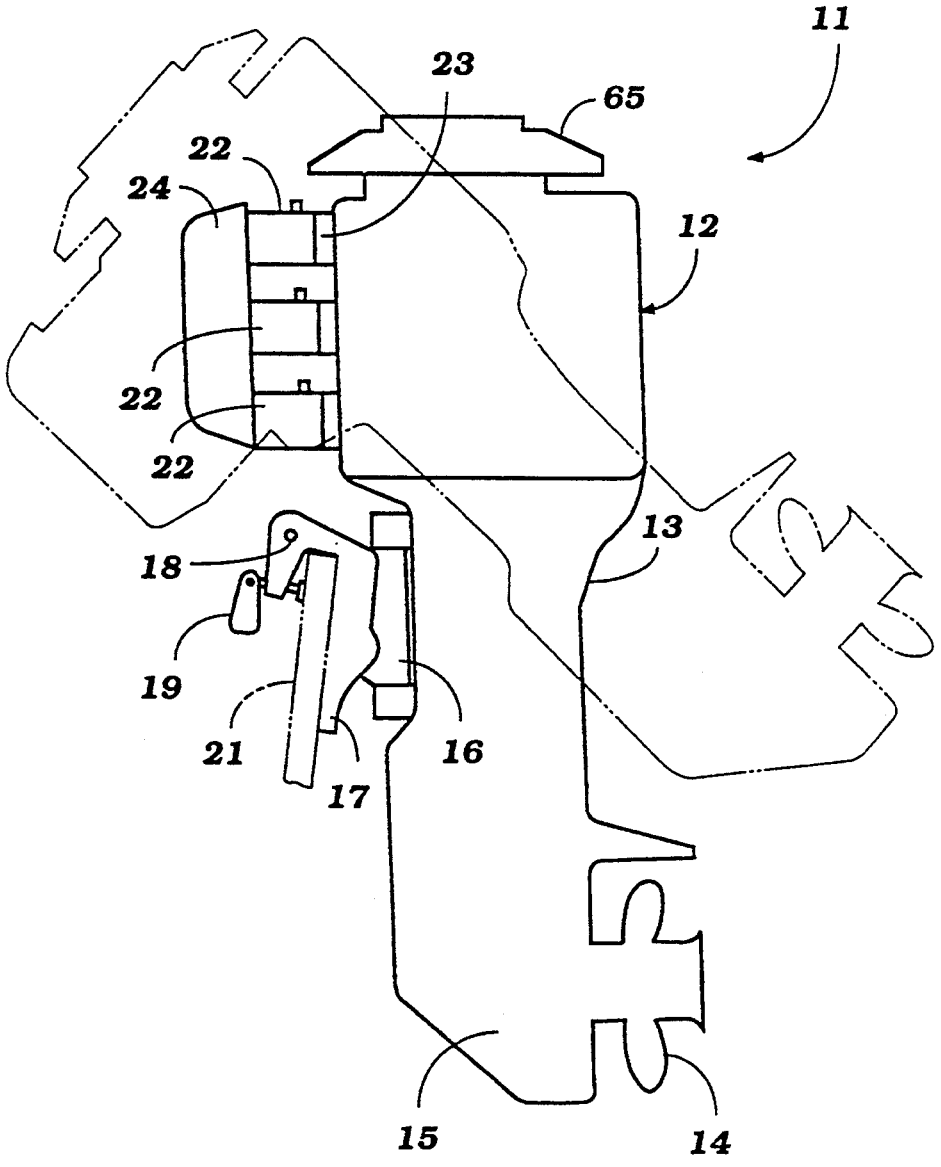
FIG. 1 is a side elevation view of an outboard motor having a fuel supply and enrichment system constructed in accordance with an embodiment of the invention.

Referring first to FIG. 1, an outboard motor having a fuel supply and enrichment system constructed in accordance with a first embodiment of the invention is identified generally by the reference numeral 11. Although the invention has utility in connection with other applications for internal combustion engines than outboard motors, it has particular utility in such applications due to the fact that outboard motors have their trim position adjusted and this can effect the fuel supply to the engine. Except, in so far as the fuel supply and enrichment system is concerned, the outboard motor 11 may be considered to conventional and, for that reason, the details of the construction of the outboard motor are not believed to be necessary to understand the construction and operation of the invention.

Outboard motor 11 is comprised of a power head consisting of an internal combustion engine 12 and a surrounding protective cowling, which is deleted from FIG. 1 so as to more clearly show the outline of the engine 12. In the illustrated embodiment, the engine 12 is comprised of a three cylinder inline crankcase compression internal combustion engine. It should be readily apparent, however, to those skilled in the art how the invention can be employed to engines having other cylinder numbers or other cylinder configurations as well as engines operating on other principals than the two stroke principal and engines other than reciprocating engines.

The engine 12, as is typical with outboard motor practice, is supported with its output shaft (not shown) rotating about a vertically extending axis and driving a drive shaft (also not shown) that is rotatably journalled in a drive shaft housing 13 for driving a propeller 14 mounted in a lower unit 15.

A steering shaft (not shown) is affixed to the drive shaft housing 13 is a known manner and is journalled within a swivel bracket 16 for steering of the outboard motor 11 about a generally vertically extending steering axis. The swivel bracket 16 is, in turn, pivotally connected to a clamping bracket 17 by a pivot pin 18 for tilt and trim movement of the outboard motor 11 about a generally horizontally extending axis. The solid line view of FIG. 1 shows the outboard motor 11 in a tilted down normal running condition while the phantom line view shows the outboard motor 11 in a tilted up out of the water condition.

The clamping bracket 17 carries a clamping device 19 for attachment of the outboard motor 11 to a transom 21 of an associated watercraft.

The outboard motor 11 and specifically the engine 12 is provided with a charge forming system that comprises, in the illustrated embodiment, three vertically positioned carburetors 22, each of which delivers a fuel/air charge to individual sealed crankcase chambers of the engine 12 through an intake manifold via an interpose spacer assembly 23. The carburetors 22 draw an air charge from an air inlet device 24.

Figure 2:
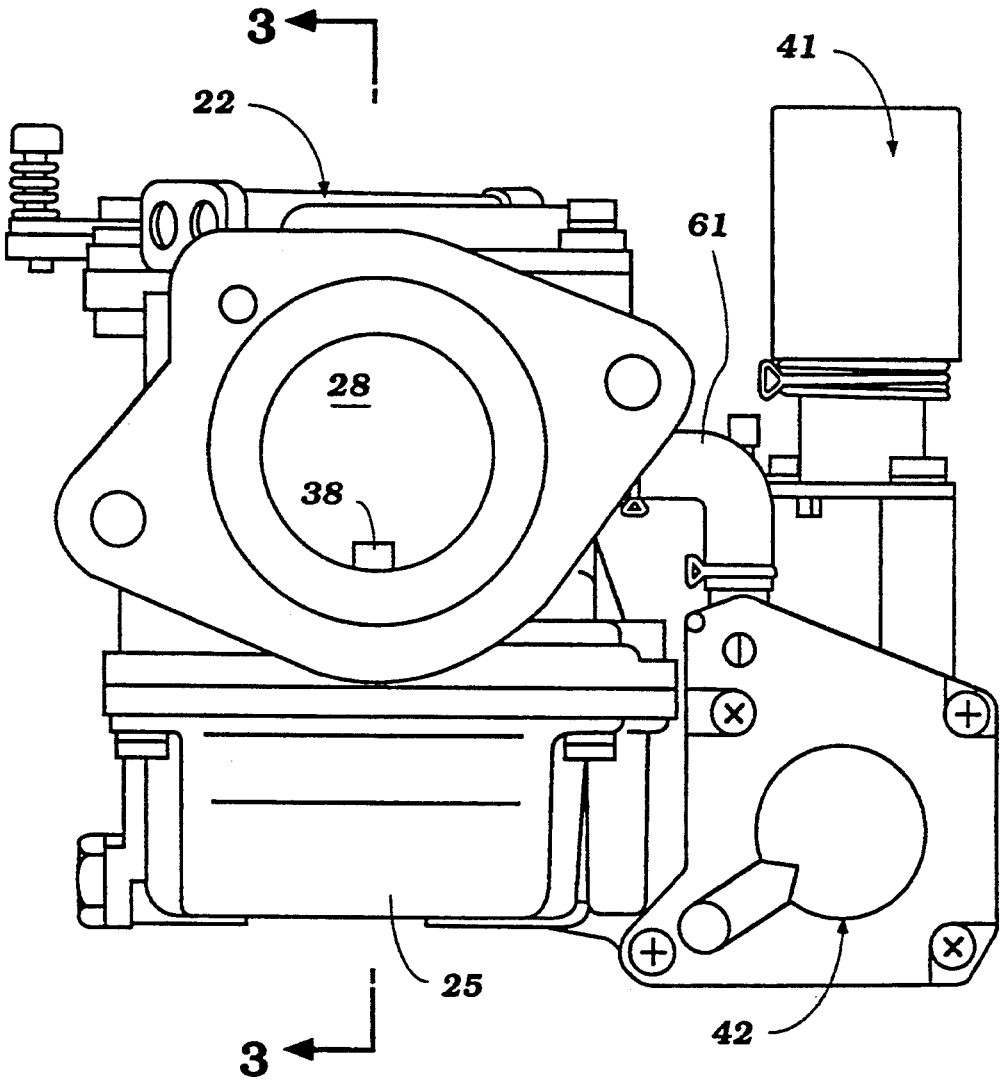
FIG. 2 is an enlarged side elevation view showing the charge former from its inlet end.
Figure 3:
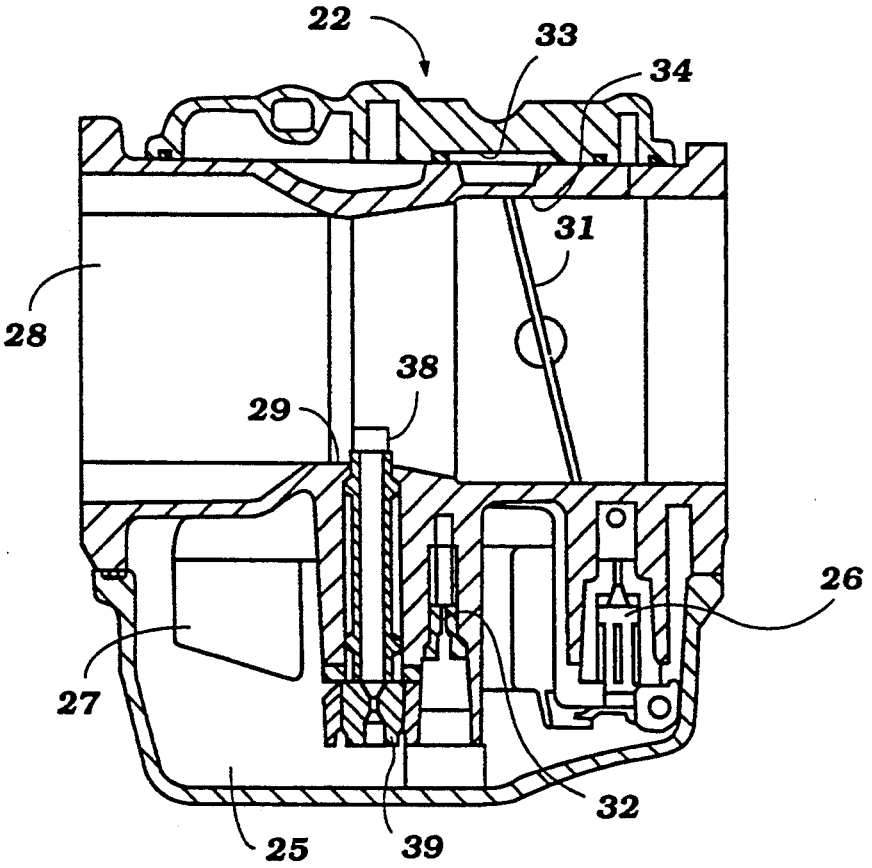
FIG. 3 is a transverse cross sectional view taken along the line 3—3 of FIG. 2.
Figure 4:
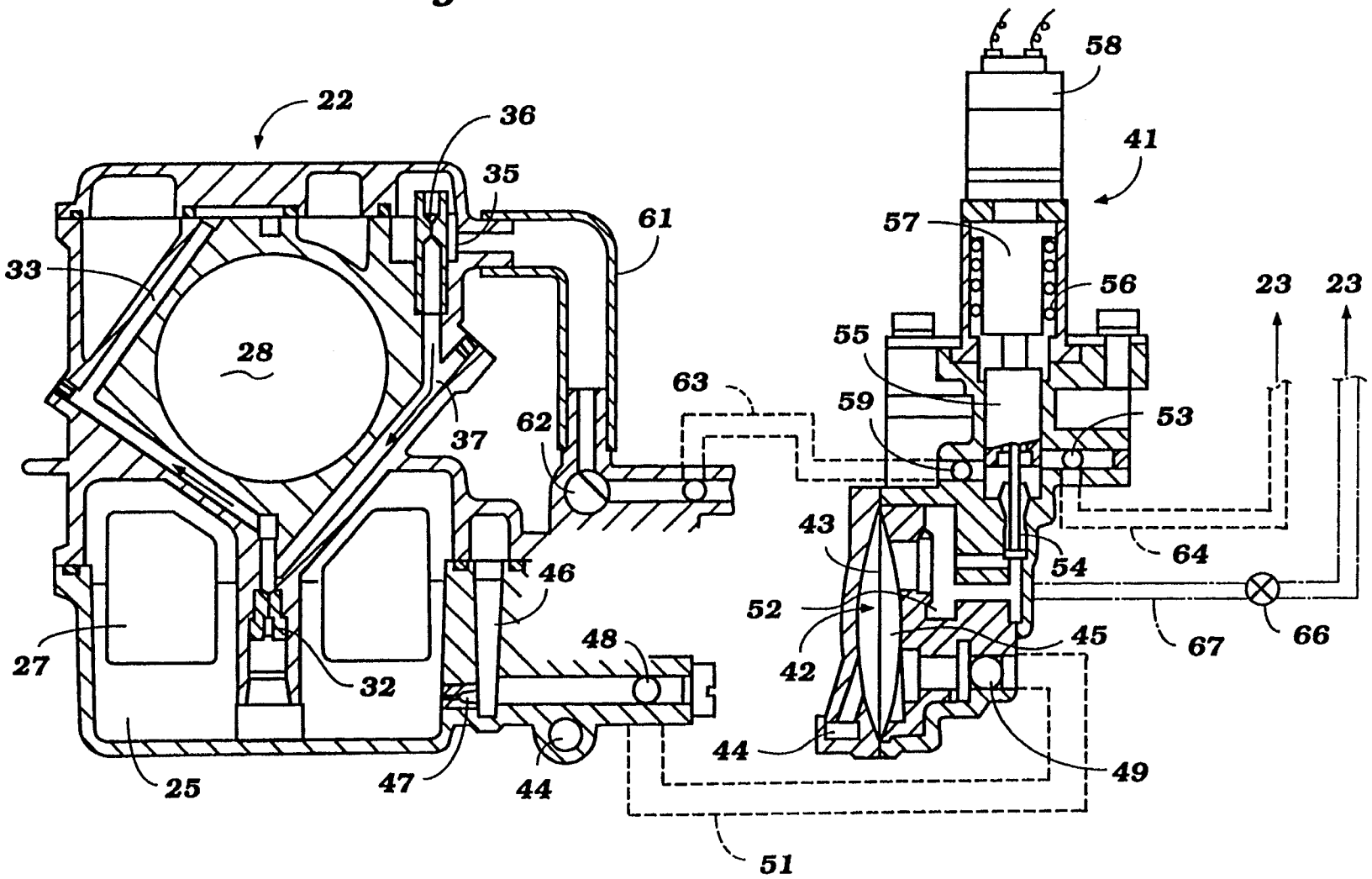
FIG. 4 is a cross sectional view taken through the charge former along a plane parallel to the plane of FIG. 2 and shows the interrelationship with the associated engine in a schematic form.

Referring now in detail to FIGS. 2 through 4, the construction of one of the carburetors 22 is illustrated and will now be described. The carburetor 22 includes a body portion from which depends a fuel bowl 25 that contains a head of fuel that is maintained at a relatively constant level by a needle valve 26 that is operated by a float 27 in a known manner.

The body portion of the carburetor 22 defines an induction passage 28 having a restricted throat 29 and in which a throttle valve 31 is positioned downstream of the throat or venturi section 29. The carburetor 22 is provided with both an idle and main fuel discharge system which draw fuel from the fuel bowl 25. The idle discharge system includes an idle jet 32 that draws fuel from the fuel bowl 25 and delivers it through an internal massage 33 formed in the body of the carburetor 22 to an idle discharge port 34 positioned downstream of the closed or idle position of the throttle valve 31. In addition to the idle discharge port 34, the carburetor 22 may also be provided with the conventional transition and mid-range ports which are also served from the idle jet 32.

Air is also mixed with the idle fuel supplied from the idle jet 32. This air is drawn from the atmosphere through a chamber 35 (FIG. 4) formed in the body of the carburetor 22 through an idle air jet 36 for delivery to the passage 33 through an air passage 37 formed in the body of the carburetor 22. As a result, a fuel/air emulsion is provided for the idle fuel air supply to the engine 12.

A main fuel discharge nozzle 38 extends into the venturi section 29 and draws fuel from the fuel bowl 25 through a main metering jet 39. Air is also mixed with the main fuel flow from the main jet 39. This air is also drawn from the air inlet 35 through an appropriate internal passage including the passage 37.

The construction of the engine 12 and the carburetor 22 as thus far described, may be considered to be conventional. For that reason, further details of the construction are not believed to be necessary to enable those skilled in the art to use the invention.

In accordance with the invention, the charge forming system for the engine is also provided with an enrichment system which includes a fuel increasing device, indicated generally by the reference numeral 41. The enrichment device 41 is attached to the body of one of the carburetors 22 and draws fuel and air from this carburetor for discharge to a balance passage formed in the spacer plate 23. This balance passage communicates at least some of the induction passages serving the individual cylinders with each other so as to provide not only an air balance between the intake passages but also a simple way of supplying fuel to multiple cylinders from one enrichment device.

The enrichment device 41 is comprised of a body portion that defines a fuel pump, indicated generally by the reference numeral 42 and which is of the diaphragm type including a diaphragm 43. One side of the diaphragm 43 is in communication with a crankcase chamber of one cylinder of the engine through a passageway 44 formed in the enrichment device 41 and the body of the carburetor 22 from which the enrichment fuel is drawn. The variations in crankcase pressure, as are present in two cycle engines, will cause the diaphragm 42 to contract and expand the volume of a pumping chamber 45.

Fuel is supplied to the pumping chamber 45 from the fuel bowl 25 of the carburetor 22 with which the enrichment device 41 is associated. This fuel supply includes a well 46 that receives fuel from the fuel bowl 25 through a metering jet 47. The well 46 with an outlet port 48 formed in the body of the carburetor 22 to supply fuel to an inlet port 49 Of the pumping chamber through a conduit 51. A check valve (not shown) is positioned between the port 49 and the pumping chamber 45 so that fuel may flow only to the pumping chamber through the conduit 51.

The pumped fuel is delivered to a pump output chamber 52 through a port in which a check valve (not shown) is positioned. The pumping chamber 52 is adapted to communicate with a fuel discharge port 53 of the enrichment device 41 under the control of a control valve 54. The control valve 54 is of the needle valve type and is connected to a piston type valve 55. The valves 54 and 55 are normally urged toward their open position by a coil compression spring 56 and will be urged downwardly against the action of the spring 56 upon the expansion of a wax pellet 57 which is heated by an electrical heater 58. FIG. 4 shows the condition when operating with a warm engine and the enrichment device 41 in essence shut off.

In addition to supplying enrichment fuel, the enrichment device 41 also supplies enrichment air which is admitted through a port 59 and which can communicate with the discharge port 53 when the piston valve portion 55 is in its opened position. Unlike prior art devices, wherein air for the port 59 is drawn from either the atmosphere directly or an area above the fuel and the fuel bowl 25, the air is supplied from the chamber 35 through a conduit 61 in which an air adjusting control valve 62 is provided. This air is delivered past the control valve 62 to the port 59 through a conduit 63. Adjustment of the control valve 62 will permit fine adjustment of the amount of air discharged.

System operates in the following manner. If the engine has been shut off and is cold, the wax pellet 57 will have contracted and the spring 56 will urge the piston valve 55 and needle valve 54 to their opened positions. When the engine is then cranked for starting, the pump 42 will deliver fuel to the port 53 and the air port 59 will also supply air past the piston valve 55 so as to provide a enriched fuel/air supply through a conduit 64 to the spacer plate 23 for delivery to the appropriate cylinders of the engine. Initially fuel will be provided at a relatively rapid rate by the enrichment device 41 until the amount of enrichment fuel in the well 46 has been depleted. This will provide an additional priming supply of fuel for use during cranking. However, once the quantity of the fuel in the well 46 has been depleted, than the metering jet 47 will control the amount of enrichment fuel supplied to the engine. This additional fuel supply will also continue once the engine starts until the wax pellet 57 is heated sufficiently by the heater 58 so as to close the supply of fuel and air for enrichment purposes. The heater 58 may be switched in an appropriate manner, for example by connecting it across the ignition circuit for the engine which includes a flywheel magneto 65 (FIG. 1) that is affixed to the upper end of the engine output shaft.

Figure 8:
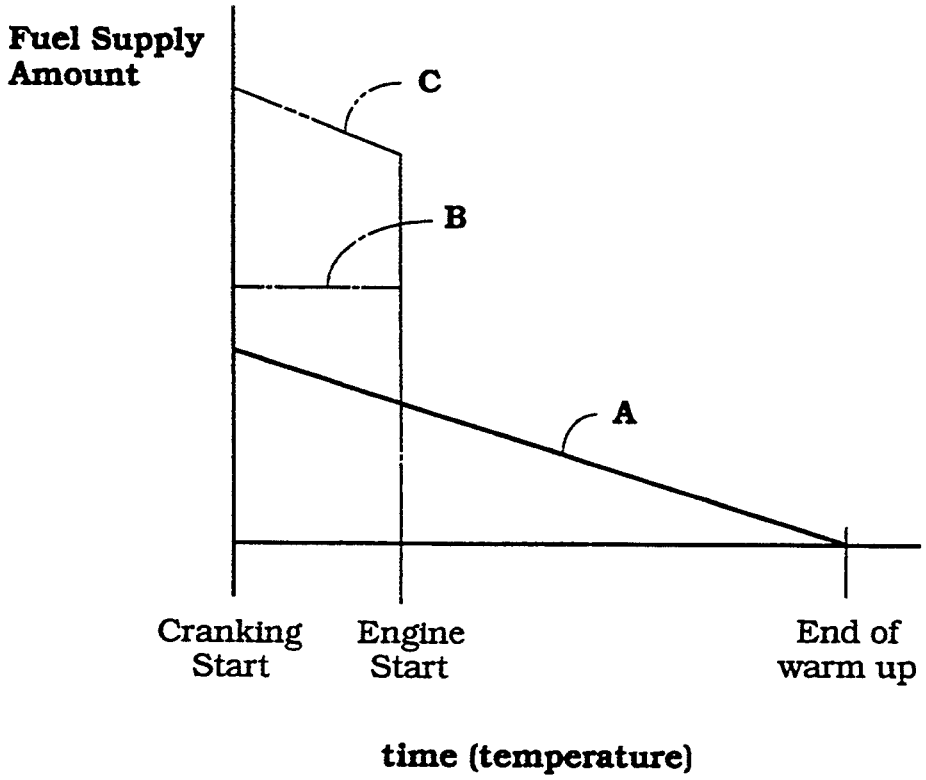
FIG. 8 is a graphical view showing the relative amounts of fuel supplied by the various systems during cold starting and cold running enrichment.

The quantity of the fuel supplied by the enrichment circuit as thus far described which delivers fuel to the conduit 64 is shown in FIG. 8 by the solid line curve A. It will be seen that the amount of fuel decreases in a relatively linear fashion as the temperature of the wax pellet 57 increases until the point in time when the needle valve 54 moves to its closed position. Although some additional fuel is provided for cranking until the well 46 is depleted, as abovenoted, this will not provide sufficient fuel for quick starting during cold cranking, for the reason aforenoted. Therefore, an additional cranking enrichment system, to be described, is provided for supplying additional fuel under this situation. This additional cranking fuel supply system will be described later.

In addition to supplying enrichment air and fuel to the engine through the conduit 64, the drawing of air from the chamber 35 of the carburetor 22 will reduce the pressure at the discharge end of both the idle jet 32 and the main jet 39 and thus will cause additional fuel to be drawn through these jets during engine running so as to provide even further enrichment. This is particularly important in conjunction with the idle jet 32 since the idle suction is relatively small due to the small size of the orifices. In addition, this reduces pressure will also minimize variations in fuel flow due to trim adjustment of the outboard motor 11. As a result, very good running will be accomplished and stalling precluded.

The structure as thus far described may be considered to be substantially the same as that shown in U.S. Pat. No. 5,150,673, issued Sep. 29, 1992 in the names of Akihiro Hoshiba et al entitled "*Fuel Supplying Device For Marine Propulsion Engine*", which patent is assigned to the Assignee hereof. As noted above, although that system is extremely effective, it may be desirable to provide more fuel flow for quicker starting during cold cranking. If the needle valve 54 and its fuel supply system is tailored so as to provide this additional fuel supply, than the system will run too rich when cranking has been completed and during cold running.

Therefore, in accordance with an embodiment of the invention, an additional enrichment system is provided for supplying additional fuel during cold cranking. This cranking enrichment system is comprised of an electrically operated cranking enrichment valve, indicated generally by the reference numeral 66 and shown schematically in FIG. 4 and in partial cross section in FIG. 5, which controls a supply of additional fuel to the spacer plate 23 through a conduit 67, which conduit 67 is also supplied from the fuel chamber 52 of the fuel pump 42. Hence, the conduit 67 and enrichment valve 66 provide additional fuel to the engine through a separate circuit from the circuit 64 controlled by the needle valve 54.

Figure 5:
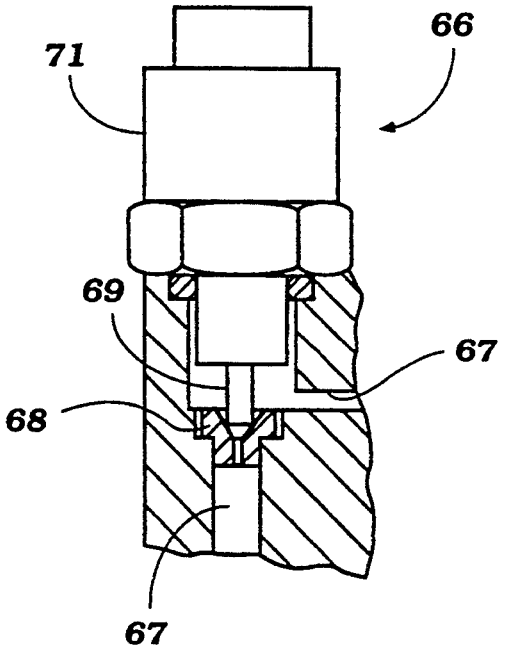
FIG. 5 is an enlarged cross sectional view showing the cold starting enrichment valve.

Referring specifically to FIG. 5, the cranking enrichment valve 66 includes the conduit 67 which is shown in FIG. 5 and in which a valve seat 68 is positioned. A solenoid operated valve element 69 operated by an electrical solenoid 71 is provided for selectively opening and closing the valve seat 68 and permitting additional fuel, without air being added, to flow to the engine through the conduit 67.

Figure 6:
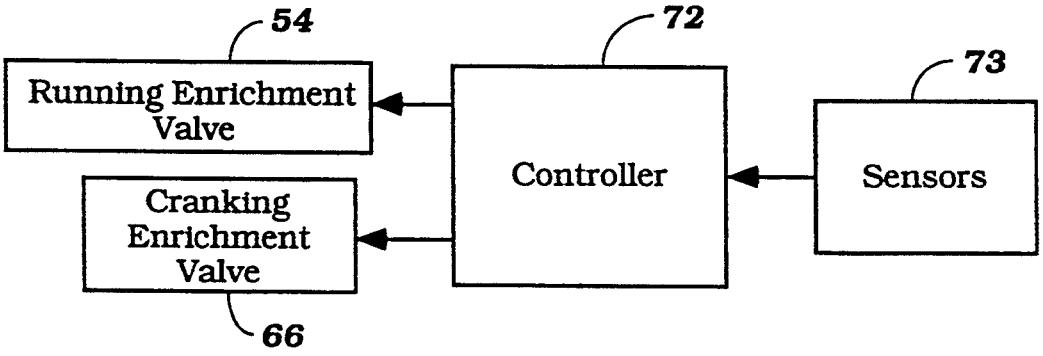
FIG. 6 is a block diagram showing the elements for controlling the various valves for cold starting and cold running enrichment in this embodiment.

The system for operating the cranking enrichment valve 66 is shown in block form in FIG. 6 and which also provides the control for the heater 58 for operating the running enrichment valve 54. This system includes a controller, indicated schematically at 72, which receives inputs from a plurality sensors 73 which may include temperature sensors and sensors for sensing when the cranking system for the engine is being operated. The controller 72 operates in accordance with a control routine as shown in FIG. 7.

Basically, when the cranking enrichment valve 71 is opened, there will be an additional fuel supply provided to the engine from the time when cranking is initiated until the engine actually starts. The amount of this additional fuel supply is shown by the dot dash (.-) curve B in FIG. 8. Hence, the total fuel supplied to the engine during cranking will be the sum of the curves A and B as indicated by the dot dot dash (..-) curve C in FIG. 8. Once the engine starts, then the additional fuel enrichment will follow only the curve A so as to provide good running and quick warm-up.

Figure 7:
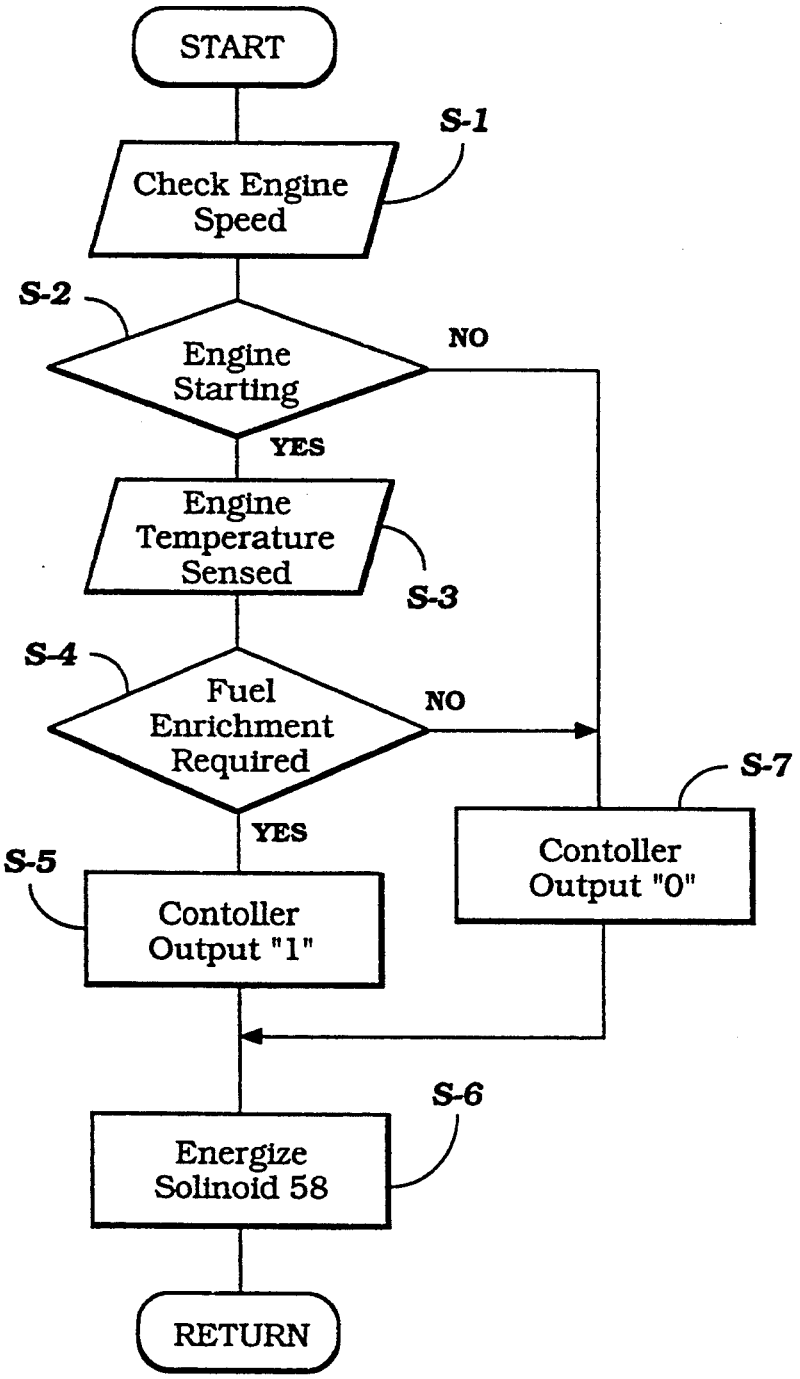
FIG. 7 is a block diagram showing the control routine of this embodiment.

Referring now to FIG. 7, the control routine for operating both the cranking enrichment valve 66 and the cold running enrichment valve 54 will be described. When the routine is started, the program moves to the first step S-1 to determine what the actual speed of the engine is. This is done to determine if the engine is being started or is running. The program then moves to the step S-2 so as to make a determination if the engine is being started or is running on its own. This is done by comparing the measured engine speed with a speed which is indicative of the fact that the engine is running on its own.

If at the step S-2 it is determined that the engine is running at a speed below the speed at which the engine will be self sustaining, it is assumed that a starting operation is taking place and the program will move to the step S-3 so as to sense the actual temperature by one of the sensors 73. The program then moves to the step S-4 so as to determine if the engine temperature is low enough to require additional cranking enrichment. If at the step S-4 it is determined that the engine temperature is such that cranking enrichment is required so as to assist in starting the engine, the program moves to the step S-5 so as to provide a controller output 1 from the controller 72 so as to energize the solenoid 71 and open the cranking enrichment valve 66. The program then moves to the step S-6 so as to energize the electric heater 58 and heat the wax pellet 57 so as to open the needle valve 54 and effect cold running enrichment until the wax pellet 57 is heated as previously noted. The program then returns.

If at the step S-2 it has been determined that the engine is not being started, the program skips to the step S-7 to output no signal from the controller 72 so that the cranking enrichment valve 66 will not be energized.

In a like manner, if at the step S-4 it is determined that the engine temperature is high enough that cranking enrichment is not required, the program jumps to the step S-7 again to insure no output from the controller 72 to energize the cranking enrichment valve 66. As a result, the enrichment curve of FIG. 8 will be followed depending upon whether the cranking temperature is low or not.

Figure 9:
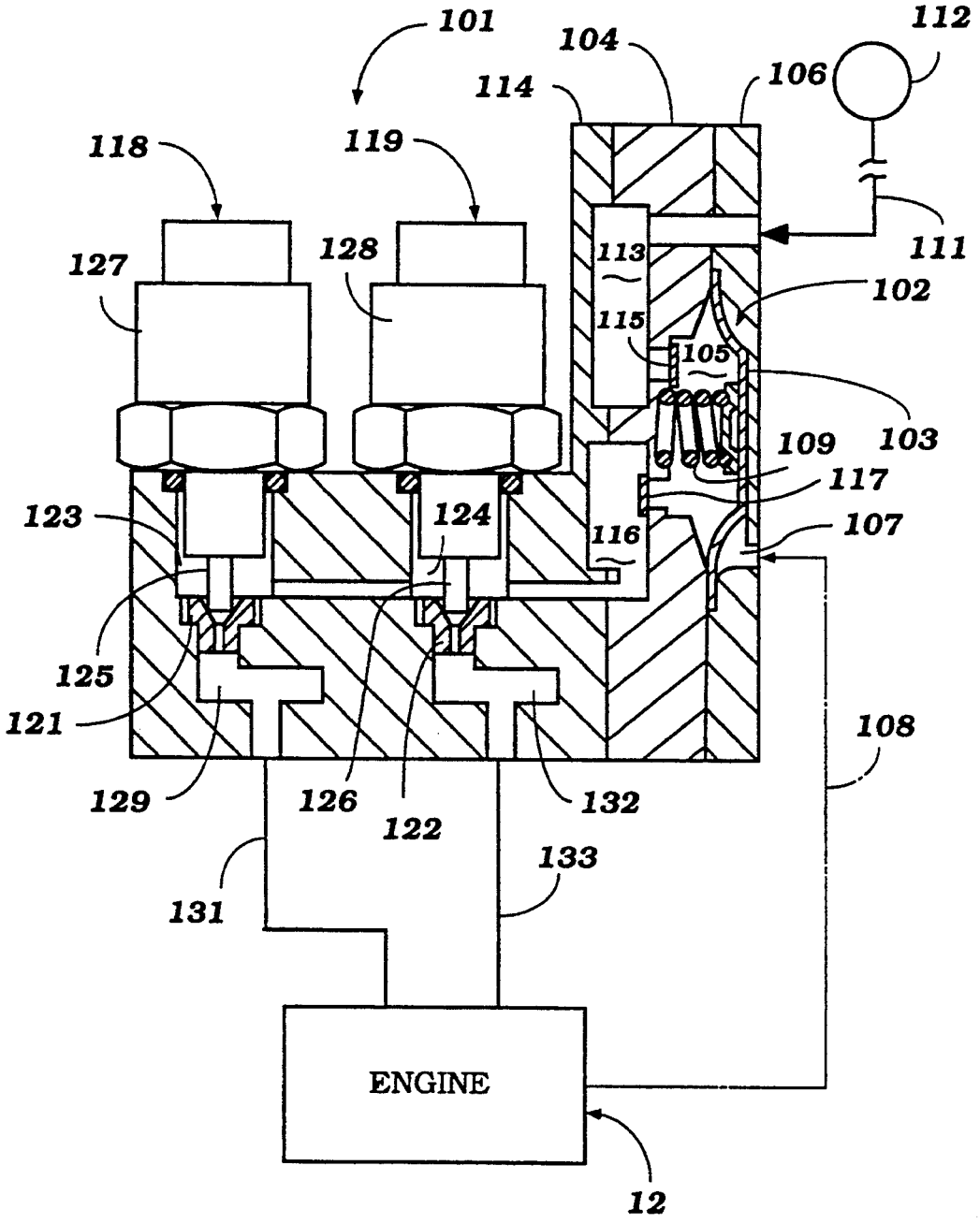
FIG. 9 is a cross sectional view, in part similar to FIG. 4, but shows another embodiment of the invention.
Figure 10:
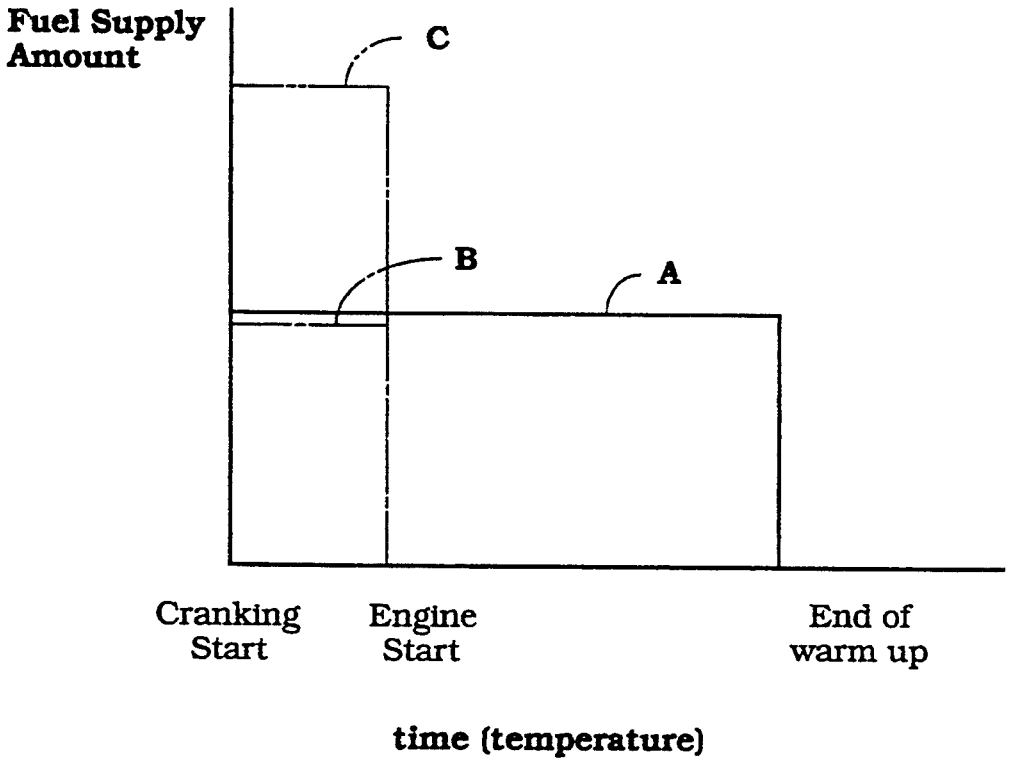
FIG. 10 is a graphical view, in part similar to FIG. 8, and shows the fuel supply of the embodiment of FIG. 9.

In the embodiment of the invention as thus far described, the cold running enrichment has been provided by a temperature responsive valve so as to provide a non-linear amount of fuel supply during the warm-up period. These types of valves are somewhat complicated and their dependence on wax pellets can give rise to certain problems. FIGS. 9 and 10 show another embodiment of the invention wherein both the cold running and cranking enrichment valves are electrically operated and this embodiment will not be described by initial reference to FIG. 9, which shows the interrelationship with the engine 12 in a somewhat schematic fashion. It is to be understood, however, that the enrichment fuel supplies are supplied to the engine in any suitable manner, such as through separate circuit to the balance passageway of the spacer 23, as in the previously described embodiment.

In this embodiment, the enrichment system is indicated generally by the reference numeral 101 and includes a diaphragm operated pump, indicated generally by the reference numeral 102. The pump 102 includes a diaphragm 103 which is mounted in the housing 104 of the enrichment device 101 in closing relationship to a pumping chamber 105. A cover plate 106 holds the diaphragm 103 in position and a driving chamber 107 is formed on the backside of the diaphragm 103. This driving chamber 107 communicated with a crankcase chamber of the engine through a conduit indicated in phantom lines at 108.

A coil compression spring 109 normally urges the diaphragm 103 to a position wherein the pumping chamber 105 will have its maximum volume. Fuel is supplied to the pumping chamber 105 through a conduit 111 from a fuel source 112 within the power head of the outboard motor. The fuel source 112 may be either a float chamber of one of the carburetors, as in the previously described embodiment or a fuel tank per se. This fuel is then delivered to a delivery chamber 113 formed by a further cover plate 114 that is affixed to the housing 104 and which communicates with the pumping chamber 105 through a delivery check valve 115. The delivery check valve 115 permits flow from the delivery chamber 113 into the pumping chamber 105 but not in the reverse direction.

When the driving chamber 107 is pressurized, the fuel in the pumping chamber 105 will be driven to a discharge chamber 116 through a delivery check valve 117. Fuel from the delivery chamber 116 is controlled by a cold running enrichment valve assembly, indicated generally by the reference numeral 118 and a cold cranking enrichment valve, indicated generally by the reference numeral 119. Each of the valves 118 and 119 is a solenoid operated valve and the valves include respective valve seats 121 and 122 which communicate with respective chambers 123 and 124 that communicate with the delivery chamber 116. Valve elements 125 and 126 are operated by the solenoids 127 and 128, respectively of the cold running and cold starting enrichment valves 118 and 119. The valve seat 121 communicates with a discharge conduit 129 formed in the cover plate 114 which, in turn, delivers fuel to the engine 12 through a cold running enrichment circuit 131. In a similar manner, the valve seat 122 communicates with a cranking supply passage chamber 132 that communicates with the engine 12 through a cranking enrichment circuit 133.

The solenoids 127 and 128 may be operated in accordance with a control routine similar to that shown in FIG. 7 and the amount of fuel supplied in relation to time and/or temperature is shown graphically in FIG. 10. The amount of fuel supplied by the cold running enrichment valve 118 is a constant amount as indicated by the curve A in FIG. 10. That is, the valve 118 is an on/off valve, as previously indicated. In a like manner, the amount of fuel supplied by the cranking enrichment valve 119 is indicated by the curve B. Hence, during the time of cranking there will be a total amount of fuel supplied which is indicated by the dash dot dot (-..) curve C which is the sum of the curves A and B. However, once the engine starts, then only the cold running enrichment curve will be followed.

It should be readily apparent from the foregoing description that the described construction and embodiments are extremely effective in insuring that there will be an adequate amount of fuel supplied for both cold cranking and cold running without excess fuel under either condition. This result is achieved through the use of two separate supply circuits, each controlled by its own respective valve. Of course, the foregoing description is that of only preferred embodiments of the invention and various changes and modifications may be made without departing from the spirit and scope of the invention, as defined by the appended claims.

We claim:

1. A cold starting and cold running enrichment device for supplying fuel to an engine having a starter for starting the engine, a running sensor for providing a signal when the engine is running, a temperature sensor for sensing temperature, said enrichment device providing fuel to said engine for cold starting and cold running enrichment comprising a first fuel circuit having a first control valve for supplying a first amount of fuel to said engine, a control for opening said first control valve when the temperature sensor senses a temperature below a predetermined temperature and when the starter is operated and for closing said first control valve when the running sensor outputs a signal indicating that the engine is running for cold starting, and a second fuel circuit having a second control valve for supplying a second amount of fuel to said engine in response to temperature for cold running enrichment, said second fuel circuit supplying fuel and air to said engine for cold running enrichment.

2. A cold starting and cold running enrichment device for supplying fuel to an engine as set forth in claim 1 wherein the first control valve is an electrically operated on/off valve.

3. A cold starting and cold running enrichment device for supplying fuel to an engine as set forth in claim 1 wherein the second control valve is a temperature responsive valve.

4. A cold starting and cold running enrichment device for supplying fuel to an engine as set forth in claim 3 wherein the temperature responsive valve comprising a wax pellet heated by an electrical heater which is energized when the temperature of the engine as sensed by the temperature sensor is below a predetermined temperature.

5. A cold starting and cold running enrichment device for supplying fuel to an engine as set forth in claim 4 wherein the first control valve is an electrically operated on/off valve.

6. A cold starting and cold running enrichment device for supplying fuel to an engine as set forth in claim 1 further including a diaphragm operated pump for pumping fuel from a fuel source to the first and second fuel circuits.

7. A cold starting and cold running enrichment device for supplying fuel to an engine as set forth in claim 6 wherein the first control valve is an electrically operated on/off valve.

8. A cold starting and cold running enrichment device for supplying fuel to an engine as set forth in claim 6 wherein the second control valve is a temperature responsive valve.

9. A cold starting and cold running enrichment device for supplying fuel to an engine as set forth in claim 8 wherein the temperature responsive valve comprising a wax pellet heated by an electrical heater which is energized when the temperature of the engine as sensed by the temperature sensor is below a predetermined temperature.

10. A cold starting and cold running enrichment device for supplying fuel to an engine as set forth in claim 9 wherein the first control valve is an electrically operated on/off valve.

* * * * *